US006478875B1

(12) United States Patent
Sampath et al.

(10) Patent No.: US 6,478,875 B1
(45) Date of Patent: Nov. 12, 2002

(54) METHOD AND APPARATUS FOR DETERMINING PROCESS-INDUCED STRESSES AND ELASTIC MODULUS OF COATINGS BY IN-SITU MEASUREMENT

(75) Inventors: Sanjay Sampath, Setauket, NY (US); Jiri Matejicek, Prague (CZ)

(73) Assignee: The Research Foundation of State University of New York, Stony Brook, NY (US)

( * ) Notice: Subject to any disclaimer, the term of this patent is extended or adjusted under 35 U.S.C. 154(b) by 0 days.

(21) Appl. No.: 09/518,224

(22) Filed: Mar. 2, 2000

Related U.S. Application Data

(60) Provisional application No. 60/122,959, filed on Mar. 3, 1999.

(51) Int. Cl.[7] ..... C23L 16/00; C23L 16/52

(52) U.S. Cl. ..... 118/712; 118/715; 118/663; 118/664; 118/665; 118/666; 118/667; 118/696; 118/697; 118/706; 118/708; 118/713

(58) Field of Search ..... 118/715, 663, 118/664, 665, 666, 667, 668, 669, 676, 696, 697, 698, 699, 706, 708, 712, 713

(56) References Cited

U.S. PATENT DOCUMENTS

| | | | | |
|---|---|---|---|---|
| 3,892,490 A | | 7/1975 | Uetsuki et al. | 356/161 |
| 4,358,471 A | * | 11/1982 | Derkacs | 427/9 |
| 4,734,577 A | | 3/1988 | Szuchy | 250/227 |
| 4,825,247 A | * | 4/1989 | Kemi et al. | 355/55 |
| 5,042,949 A | | 8/1991 | Greenberg et al. | 356/345 |
| 5,118,955 A | | 6/1992 | Cheng | 250/561 |
| 5,248,889 A | | 9/1993 | Blech et al. | 250/561 |
| 5,507,870 A | * | 4/1996 | Siebert | 118/664 |
| 5,610,715 A | * | 3/1997 | Yoshii et al. | 356/356 |
| 5,755,511 A | | 5/1998 | Peuse et al. | 374/128 |
| 6,050,138 A | * | 4/2000 | Lynch et al. | 73/150 A |

OTHER PUBLICATIONS

W. Bruckner et al., "Apparatus for the Laser–Optical Measurement of Stress in Thin Films: Results on CuNi," Review of Scientific Instruments, vol. 69, No. 10, pp. 3662–3665 (Oct., 1998).

J. A. Floro et al., "Real Time Measurement of Epilayer Strain Using a Simplified Wafer Curvature Technique," MaL Res. Soc. Symp. Proc., vol. 406, pp. 491–496 (1996).

A. L Shull et al., "Measurements of Stress During Vapor Deposition of Copper and Silver Thin Films and Multilayers," J. Appl. Phys., vol. 80, No. 11, pp. 6243–6256 (1996).

* cited by examiner

*Primary Examiner*—Jeffrie R. Lund
(74) *Attorney, Agent, or Firm*—Baker Botts L.L.P.

(57) ABSTRACT

An apparatus for performing in-situ curvature measurement of a substrate during a deposition process is provided which includes a clamp for retaining the substrate near one end while leaving the opposite end free. A plurality of displacement sensors are arranged in a spaced apart fashion along the length of the substrate and are directed to a surface of the substrate opposite a surface to be coated. Each sensor provides a signal to a computer corresponding to a position of the substrate relative to the sensor. The computer receives and stores data from the displacement sensors to determine a stress evolution during a deposition process and to determine a coating modulus based upon a resultant curvature of the substrate.

8 Claims, 6 Drawing Sheets

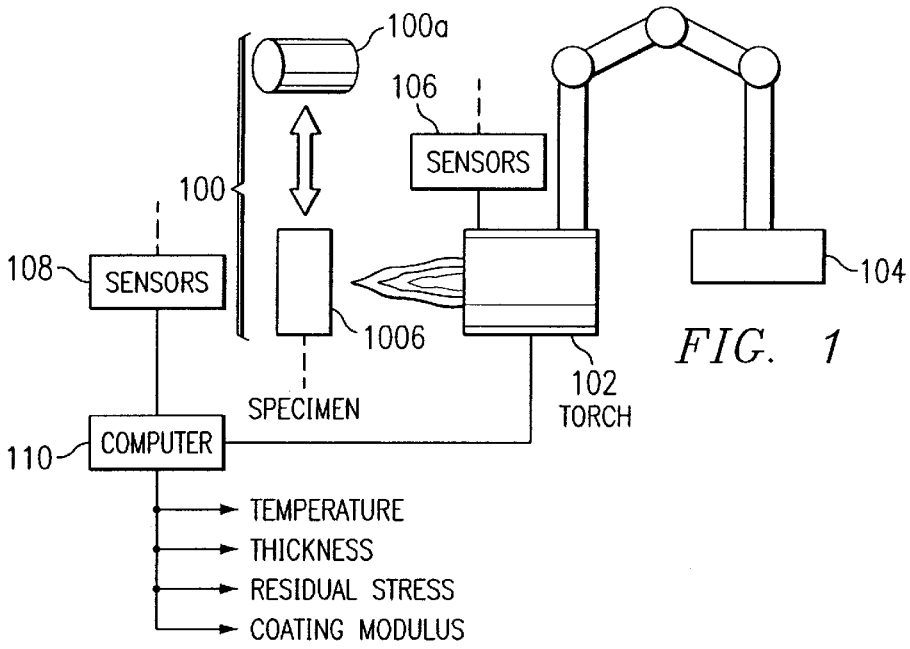
FIG. 1
FIG. 2
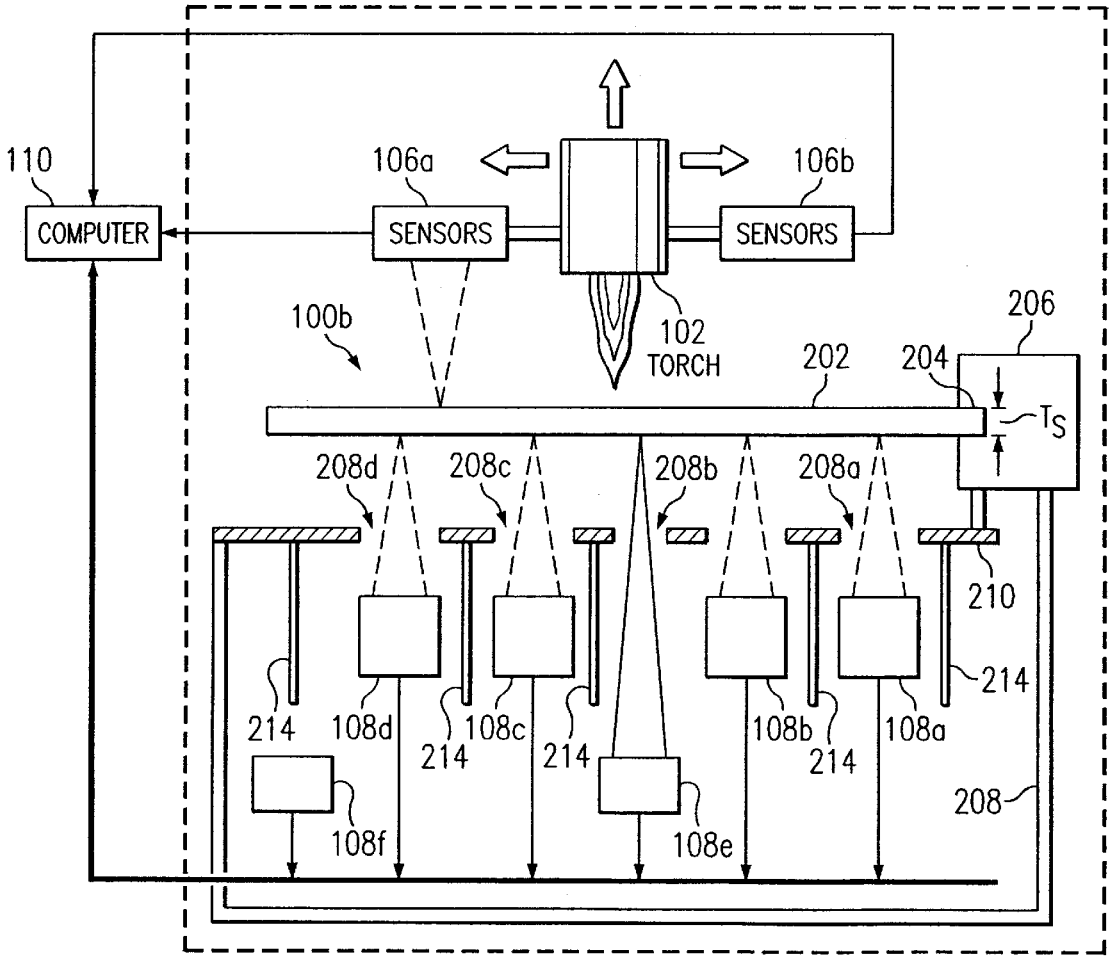

METHOD AND APPARATUS FOR DETERMINING PROCESS-INDUCED STRESSES AND ELASTIC MODULUS OF COATINGS BY IN-SITU MEASUREMENT

This application claims the benefit of U.S. Provisional Patent Application Ser. No. 60/122,959, entitled METHOD AND APPARATUS FOR DETERMINING PROCESS-INDUCED STRESSES AND YOUNG'S MODULUS OF COATINGS BY IN-SITU MEASUREMENT, filed on Mar. 3, 1999.

FIELD OF THE INVENTION

The present invention relates generally to spray coating and more particularly relates to methods and apparatus for in-situ measurement of stress and modulus during coating.

BACKGROUND OF THE INVENTION

In spray coating operations, residual stress is important for the integrity of the deposit-substrate system as well as its performance. If the magnitude of the residual stress is too high, the coating may crack, delaminate from the substrate, cause substrate warpage and the like. In service, the existing residual stress superposes with the applied stress (coming from high temperature excursions, contact with other bodies, etc.) and if the resulting stress exceeds a maximum allowable limit, failure may occur or fatigue life may be shortened. If the residual stress in the system has such a magnitude and distribution that it reduces the effects of in-service stress, it will have a beneficial effect on the component life. Therefore, it is desirable to control the stress and to understand its generation. With this understanding, process modifications can be undertaken to achieve desired properties, not only by trial-and-error but by applying the knowledge of the processing phenomena.

In thermally sprayed coatings the stress has two principal origins. First, "quenching" or "deposition" stress, results from rapid quenching of a molten droplet upon impact on the substrate while its contraction is restricted by adherence to the substrate. This stress component is always tensile. The second stress component, "thermal" stress, results during cooling of the completed deposit+substrate couple from deposition temperature to ambient temperature with the stresses developing due to differences in thermal expansivities between the substrate and the coating. Depending on the sign of this difference, the so-called "thermal" stress can be tensile or compressive. The superposition of these two stress contributions constitutes the final residual stress. In planar systems, the stresses generally exhibit themselves by curvature of the substrate/deposit couple.

Also of significance in evaluating the efficacy of a elastic modulus of the resulting coating. The importance of the elastic modulus in this regard is two-fold. First, the magnitude of the modulus is a direct indicator of the quality of bonding between the particle layers as well as porosity. As such, the modulus has a strong influence on the performance of the coating, e.g., in applications involving wear, erosion etc. Second, the magnitude of thermal stress is, for a given temperature difference, roughly proportional to the magnitude of the coating modulus. Therefore, a variation of the modulus strongly affects the final stress.

The stresses that are incurred during coating operations and the coating modulus of the coating are important to consistent coating quality. Therefore, it would be desirable to determine these characteristics in an in-situ manner such that the coating parameters can be adapted to insure highly consistent, high quality coatings on a substrate.

SUMMARY OF THE INVENTION

It is an object of the invention to determine process induced stresses of coatings using in-situ measurements.

It is another object of the invention to determine an elastic modulus, such as Young's modulus, of coatings using in-situ measurements.

It is a further object of the invention to provide systems and methods for determining process induced stress and elastic modulus of a coating using in-situ temperature and curvature measurements.

In accordance with a first embodiment, an apparatus for performing in-situ curvature measurement of a substrate during a deposition process is provided which includes a clamp for retaining the substrate near one end while leaving the opposite end of the substrate free. A plurality of displacement sensors are arranged in a spaced apart fashion along the length of the substrate and are directed to a surface of the substrate opposite a surface to be coated. Each sensor provides a signal to a computer corresponding to a position of the substrate relative to the sensor. The computer receives and stores data from the displacement sensors to determine a stress evolution during a deposition process and to determine a coating modulus based upon a resultant curvature of the substrate.

The apparatus can also include a temperature sensor for providing a signal to the computer indicative of the substrate temperature during a deposition process. In another embodiment, a further displacement sensor is included which is directed to the surface of the substrate being coated, such that the deposition coating thickness can be determined. When the displacement sensors are aligned such that they are directed to a common point on the substrate, an accurate differential thickness measurement can be obtained.

A method for determining residual stress on a substrate following deposition coating in accordance with the present invention includes the steps of fixing one end of the substrate; measuring the displacement of the substrate at a plurality of points along a length of the substrate during deposition coating to determine a magnitude of curvature of the substrate; using an initial estimation of coating modulus for the substrate along with the displacement measurements to determine an estimate of the residual stress on the substrate; and using the estimate of the residual stress on the substrate to refine the estimate of the coating modulus.

A further embodiment of the present method includes the step of measuring the displacement of the substrate at a plurality of points along a length of the substrate during a cooling cycle after deposition coating to determine a magnitude of curvature of the substrate and residual stress of the substrate-coating couple.

In addition to the coating modulus and residual stress, the thermal stress and quenching stress components can also be determined.

A method of determining the thickness of a deposit coating is also provided. Such a method includes the steps of measuring an initial natural frequency and/or an initial damping factor of a substrate. An expected natural frequency and damping factor for the substrate having a desired coating thickness is calculated. During coating, periodic measurements of the natural frequency and/or damping factor of the coated substrate are performed and the coating process is terminated when the measured damping factor and/or natural frequency substantially match the expected damping factor and/or natural frequency, respectively.

These and other objects, features and advantages of the invention will become apparent from the detailed description of preferred embodiments set forth below.

DESCRIPTION OF THE DRAWINGS

FIG. 1 is a schematic diagram illustrating an apparatus formed in accordance with the present invention;

FIG. 2 is a cross sectional schematic diagram further illustrating an arrangement of sensors along a specimen in the apparatus of FIG. 1;

DESCRIPTION OF PREFERRED EMBODIMENTS

Figure 3A:
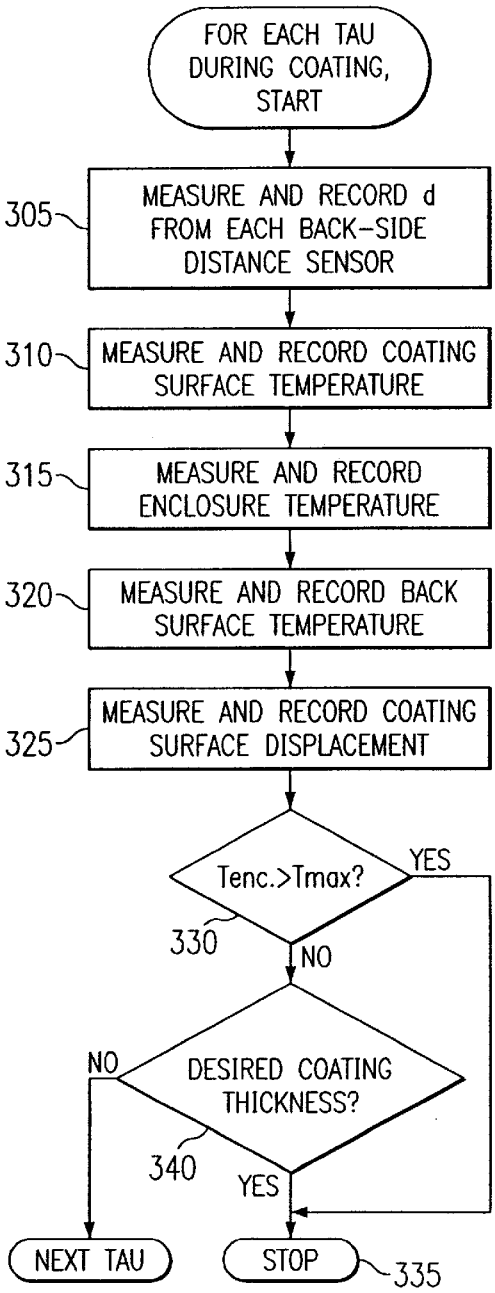
FIGS. 3A–3C are flow charts illustrating an exemplary method of determining process induced stresses in a material which has been coated.

FIG. 1 illustrates an exemplary spray coating system in accordance with the present invention. The system includes a deposition torch 102 mounted at a manipulator end of a robotic arm 104 which directs the deposition torch 120 over the surface of a substrate 100 to be coated. The substrate 100 can include a finished article to be coated 100*a* and a test specimen 100*b*. The deposition torch 102 can take the form of any known spray deposition torch, such as plasma, high velocity oxy-fuel ("HVOF"), wire arc, cold spray and the like. The exact embodiment of the robotic arm 104 is not critical. Depending on the nature of the article 100*a* to be coated, the robotic arm 104 can take the form of a simple X-Y table for planar articles or a complex, jointed arm with six-degrees of rotational freedom, for articles having a complex contour.

A first group of sensors 106 is mounted on the deposition torch 102. A second group of sensors 108 is mounted behind the test specimen 100*b*, e.g., on a side opposite the surface to be coated. The sensors 106, 108, robotic arm 104 and torch 102 are coupled to a computer 110 which monitors and controls the coating process.

FIG. 2 is a schematic diagram of a cross-sectional view of the instrument of FIG. 1, further illustrating the arrangement of the first and second group of sensors 106, 108 with respect to the test specimen 100*b*. The test specimen 100*b* is an elongate cantilever which has a free end 202 and a fixed end 204 which is rigidly mounted in a clamp 206. The test specimen is generally rectangular in cross-section and includes a surface to be coated and an opposing back surface. The sensitivity of displacement to deposition stress ($d\delta/d\sigma$) is proportional to the length (l) of the test specimen 100*b*, and is inversely proportional to the square of the thickness, $t_s$, of the test specimen 100*b*. This gives the experimenter a degree of flexibility in selecting the substrate dimensions according to the stress magnitude expected from a given process and to the specifications of the sensors 106, 108. An exemplary test specimen 100*b* formed from steel, aluminum, super alloy and the like with the dimensions of about 1.93×25×200 mm (ts×w×l), has been found to provide a suitable magnitude of measurable displacements during a typical coating operation.

The second group of sensors 108 includes a number of non-contacting displacement sensors 108*a*, 108*b*, 108*c*, 108*d* which are spaced along the length of the test specimen 100*b*. Sensors 108 can take the form of laser distance sensors, such as model number LM-10 manufactured by Aromat Automation Controls Division of new Providence, N.J. Such sensors can accurately measure the distance to the test specimen 100*b* via laser triangulation. By taking measurements from the sensors 108*a–d* along the length of the test specimen 100*b*, the radius of curvature of the test specimen during coating and during cooling can be determined. The distance data from each of the sensors 108*a–d*, measured from the back of the test specimen 100*b*, is coupled to the computer 110 which can calculate the curvature of the test specimen 100*b* from these data, such as by fitting the data to an appropriate circular arc.

The temperatures of the coating surface and back side of the test specimen 100*b* can be measured by an optical pyrometer 106*a* in the first group of sensors 106 and a thermocouple 108*e* in the second group of sensors, respectively. The first group of sensors 106 can also include a noncontacting displacement sensor 106*b*. The thickness of the coating being applied can be determined at the computer 110 by subtracting data from the displacement sensor in the first group of sensors 106 from data provided by the second group of sensors 108.

The second group of sensors 108 are preferably mounted within an enclosure 208 to protect the sensors from the harsh environment of the spray chamber. The top surface 210 of the enclosure 208 can be formed with a thermally isolating material to protect the sensors 108 from the extreme heat of the spray processes. The top surface 210 includes small optical windows 212 through which the laser light of the non contacting proximity sensors 108*a–d* are directed. To insure that the laser displacement sensors do not interfere with one another, the sensors 108*a–d* can be isolated from one another with optical partitions 214.

The optical pyrometer 106*a* can be mounted on the torch 102 or on a separate stand. Suitable pyrometers are manufactured by Omega Engineering, Inc, of Stamford, Conn., and include model number OS37-10-K for low emissivity targets and model number OS38-10-K for high emissivity targets. Such pyrometers have a sensing range of −45 to 815° C. and 260 to 1370° C., respectively and a measured spot size of 20 mm at an optimum distance of 200 mm (at larger distances, the spot size increases at 1:10 ratio with distance). The temperature of the back side of the substrate can be measured by a K-type thermocouple attached to the back of the substrate, which is also available from Omega Engineering. In addition, the temperature inside the enclosure 208 can also be measured by another thermocouple 108*f*, to ensure that the sensors are not overheated during a measurement period.

The computer 110 includes interface circuitry (not shown) and controller functions to receive and process signals from the sensors 106, 108. The computer 110 can take the form of a general purpose "personal computer" interfaced to dedicated controllers for each sensor or can be a dedicated computer system which includes the appropriate controller/interface circuitry for the sensors integrated therein. In the former case, displacement sensor controllers such as model number ANR5131, from Aromat, Automation Controls Division, of New Providence, N.J., can be used to convert the signal from the sensors 108*a–d* to a 1 mV per gm output signal. Thermocouple controllers, such as the Omega Engineering TAC-80B-K, are suitable for the present invention and provide an output of 1 mV per degree C. A pyrometer controller, such as the Omega Engineering CCT-23 can be used to provide an output signal of 8.33 mV per degree C.

Figure 3B:
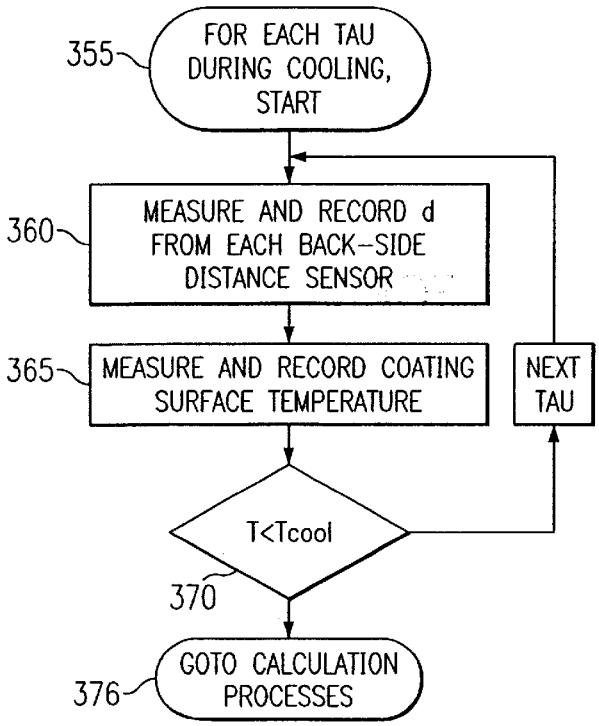
Figure 3C:
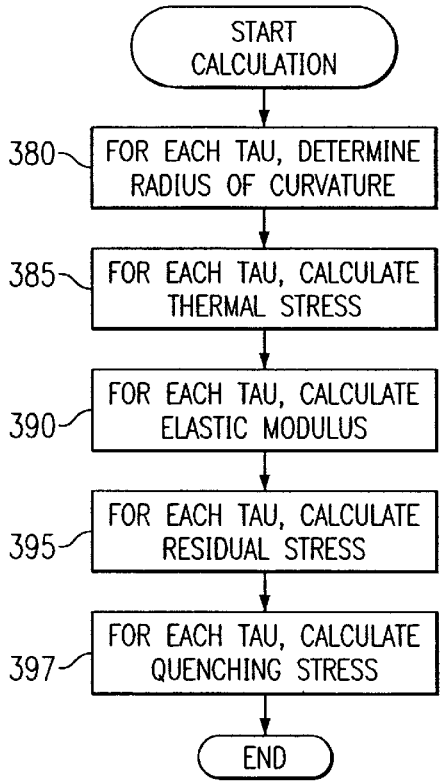

FIGS. 3A through 3C are flow charts illustrating steps in a method of determining process induced stresses and the elastic modulus of a coating in accordance with the present invention. During deposition coating, a number of measurements are performed and the measurement results are stored, such as in memory or non-volatile storage of computer 10. The displacement value of each of the sensors 108*a–d* is recorded (step 305). The temperature of the coating surface, as measured by thermal sensor 106*b* is recorded (step 310). The temperature of the back surface of the test specimen is recorded by thermocouple 108*e* (step 320). The temperature within the enclosure ($T_{enc}$) is also recorded (step 315) as is the displacement measurement from the displacement sensor 106*a* on the coating side of the test specimen (step 325). The temperature within the enclosure ($T_{enc}$) is compared against a maximum allowable temperature for the sensors ($T_{max}$) to determine whether the sensors 108 are operating within an allowable temperature range (step 330). If the temperature exceeds the maximum value, the deposition processing can be suspended (step 335). The current coating thickness can be calculated from the displacement measurements during each measurement interval ($\tau$) to determine if the coating deposition process is complete at that given location of the sensor 106*a* (step 340).

After deposition of the coating is complete, data recordation continues as the coated test specimen 100*b* cools to ambient temperature. Referring to FIG. 3B, for each time interval ($\tau$) during cooling (step 355), the measured values from the displacement sensors 108*a–d* are recorded (step 360). The coating and back surface temperatures of the specimen are also recorded (step 365). When the displacement and/or temperature data approach constant values, or the predetermined cooling period has expired (step 370), a calculation processing module is begun (step 376).

FIG. 3C illustrates the steps employed in an exemplary calculation processing module. For each $\tau$, the radius of curvature of the test specimen is determined (step 380). This can be performed by mathematically fitting the test specimen 100*b* displacement data to an appropriate circular arc. From the curvature data, the thermal stress of the test specimen can be calculated (step 385). For example, upon cooling, the curvature of the test specimen 100*b* changes with temperature due to thermal stresses in accordance with Equation 1 below:

$$\Delta k = \frac{6E_D E_S t_D t_S (t_D + t_S)\Delta T \Delta\alpha}{E_D^2 t_D^4 + 4E_D E_S t_D^3 t_S + 6E_D E_S t_D^2 t_S^2 + 4E_D E_S t_D t_S^3 + E_S^2 t_S^4} \quad (1)$$

where $\Delta k$ is the change in curvature with a change in temperature $\Delta T$, $\Delta\alpha$ is the difference in thermal expansivities between the deposit and the substrate, $E_D$ and $t_D$ are the deposit Young's modulus (elastic modulus) and thickness, $E_S$, and $t_S$ are the corresponding values for the substrate. Equation 1 is described in "An Analytical Model for Predicting Residual Stresses in Progressively Deposited Coatings" by Tsui and Clyne, Part 1: Planar Geometry; Thin Film Solids, Vol. 306, No. 1, 1997, pp 23–33. Thermal expansivities are quite insensitive to processing conditions and can be measured separately (e.g., by dilatometry). Therefore, if the system behaves elastically (in other words, if it follows the above relationship), the elastic modulus of the deposit can be determined. Any significant deviation from this behavior can serve as an indication of some inelastic process (plastic deformation, deposit delamination).

From the thermal stress calculations, the elastic modulus can be calculated (step 390). Once the modulus is determined, the residual stress can be calculated (step 395) and the quenching stress can be calculated (step 397), such as by using the formula of Brenner and Senderoff, in "Calculation of Stress in Electrodeposits from the Curvature of the Plated Strip," J. Res. Natl. Bur. Stand., Vol. 42, 1949, pp105–123, set forth below as equation 2.

$$\sigma_q = \frac{E_S t_S (t_S + \beta^{5/4} t_D)}{6Rt_D}; \beta = \frac{E_D}{E_S} \quad (2)$$

where $\sigma_q$ is the quenching stress in the deposit, $E_D$ and $t_D$ are the elastic modulus and thickness of the deposit, and $E_S$ and $t_S$ are the corresponding values for the substrate and R is the radius of curvature. For thin coatings, the result is not very sensitive to deposit modulus and an estimated value can be used. Otherwise, the modulus is calculated in subsequent analysis of the post-deposition cooling curves and then the quenching stress can be back-calculated more precisely.

Figure 4:
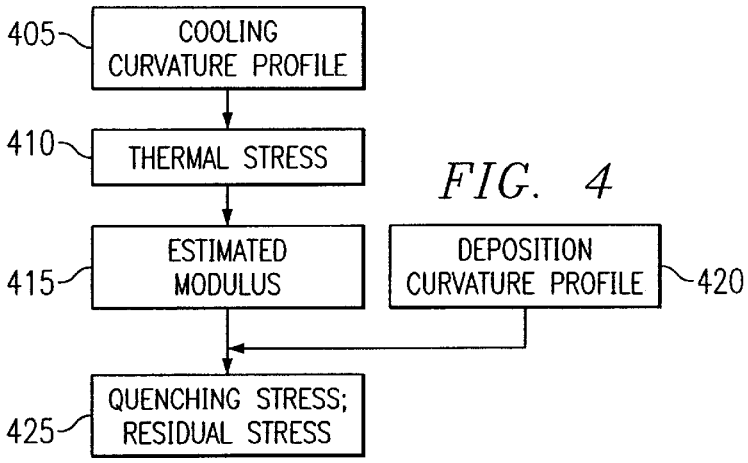
FIG. 4 is a block diagram illustrating the relationship between measured cantilever curvature data, the process stresses and elastic modulus derived therefrom.

The relationship between the measured curvature data and the derived stress profiles is illustrated in the block diagram of FIG. 4. From the measured cooling curvature profiles 405 the thermal stress of the specimen 410 is determined. From the thermal stress 410 the elastic modulus 415 is estimated. From the estimated elastic modulus 415 and the measured deposition curvature data 420 the quenching stress and residual stress profiles 425 can be calculated.

Figure 5:
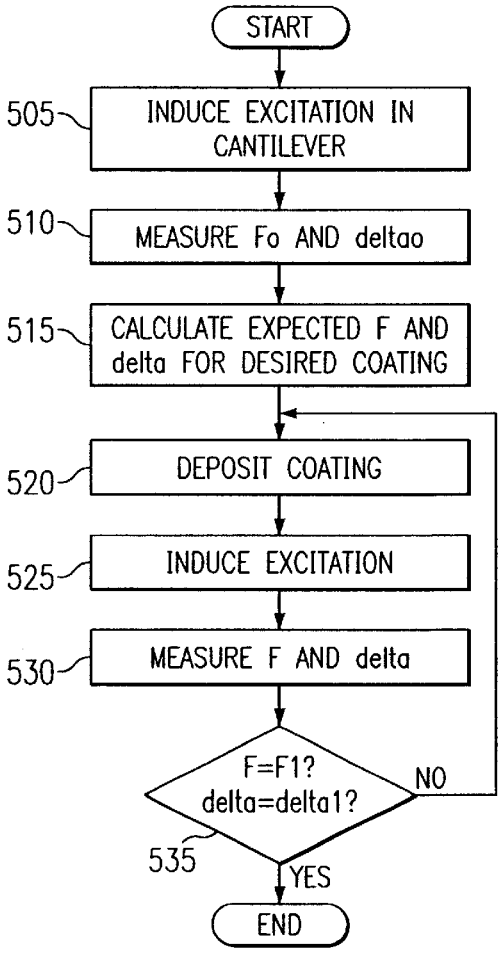
FIG. 5 is a flow chart illustrating a method of determining a coating thickness in real time.
Figure 6:
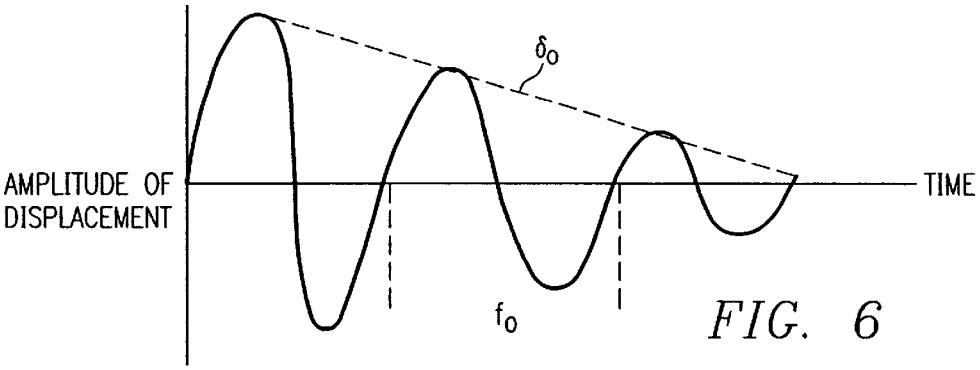
FIG. 6 is a graph illustrating exemplary behavior of a cantilever subjected to an excitation impulse.

A method for determining the coating properties of a test specimen in real-time which is suitable for implementation by the apparatus of FIGS. 1 and 2 is illustrated in FIG. 5. As noted in connection with FIG. 2, the test specimen 100*b* takes the form of an elongate cantilever beam. As such, it will exhibit a natural frequency (F0) and a characteristic damping coefficient ($\delta$) of oscillation which are determined by the material properties and dimensions of the test specimen. When impinged with the coating torch, an excitation is induced in the cantilever and the free end of the test specimen will exhibit a damped oscillatory displacement characteristic exemplified by the graph illustrated in FIG. 6.

Referring to FIG. 5, prior to coating, an initial excitation is induced in the test specimen 100*b* to establish an oscillation therein (step 505). The natural frequency ($F_0$) and damping coefficient ($\delta_0$) of the substrate are determined (step 510). This can be accomplished by analyzing the displacement data from the sensor 108*d* proximate the free end 202 of the test specimen 100*b*. Using the desired coating thickness and coating parameters, the expected frequency ($F_1$) and damping coefficient ($\delta_1$) of the coated substrate can be calculated (step 515). The coating process then commences at step 520. As the stream of plasma from torch 102 impinges the test specimen 100*b*, an excitation is induced in the test specimen 100*b* (step 525) and the current frequency ($F_\upsilon$) and damping coefficient ($\delta_\upsilon$) can be determined (step 530). The values of the current frequency and damping coefficient are then compared to the desired results (step 535). If the desired frequency and damping factor have been detected, then the coating process is complete. If the expected frequency and damping coefficient have not been attained, coating continues (step 520). Either one or both of the parameters, frequency and damping factor, can be used to make this determination.

The present systems and methods are particularly well suited for use as a process control instrument for spray coating operations. As noted in connection with FIG. 1, the article 100*a* being coated and the test specimen 100*b* can be separate items. For example, the article 100*a* can take the form of an object having complex contours, such as a turbine blade. The test specimen 100*b* will always take the form of a strip, as described above. During spray coating of the article 100*a*, the coating process of the article 100*a* can be interrupted to spray the test specimen 100*b*. The properties of the spray coating of the specimen can be compared against known data in real-time to insure that the spray coating parameters are within the tolerance bounds. The test specimen 100*b* can also be saved to archive the operation of the spray coating process for quality control purposes. Such data can be stored and used locally by computer 110, and can also be transmitted to remote monitoring sites, such as by way of a local area network or Internet communication connection (not shown).

Experimental Results

Figure 7:
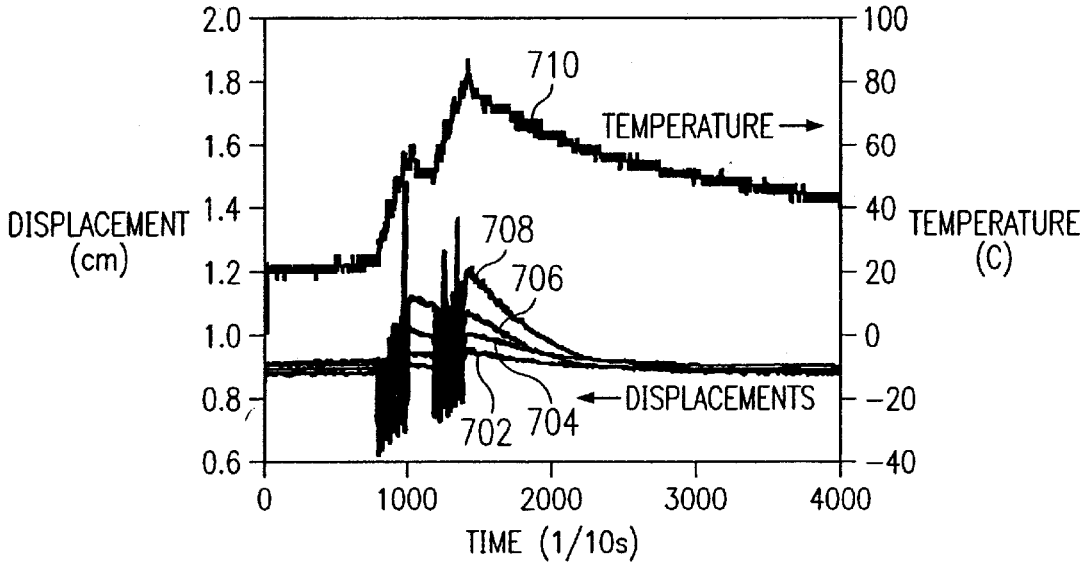
FIG. 7 is a graph of displacement and temperature versus time, from the exemplary displacement sensors in FIG. 2 during a deposition process on the specimen.

FIG. 7 is a graph of raw data output from the displacement sensors 108*a–d* and thermocouple 108*e*. Graph line 702 corresponds to the data from sensor 108*a*; graph line 704 corresponds to the data from sensor 108*b*; graph line 706 corresponds to the data from sensor 108*c*; and graph line 708 corresponds to the data from sensor 108*d*. The specimen coating history can be best observed on the temperature profile 710 (top series): one spraying sequence corresponds to the temperature rise between 80 and 100 s, followed by a short intermission, another spraying sequence from 120 to 140 s and subsequent cooling. The displacements have increasing relative amplitude from near the clamped end 204 to near the free end 202 of the test specimen 100*b*.

Figure 8:
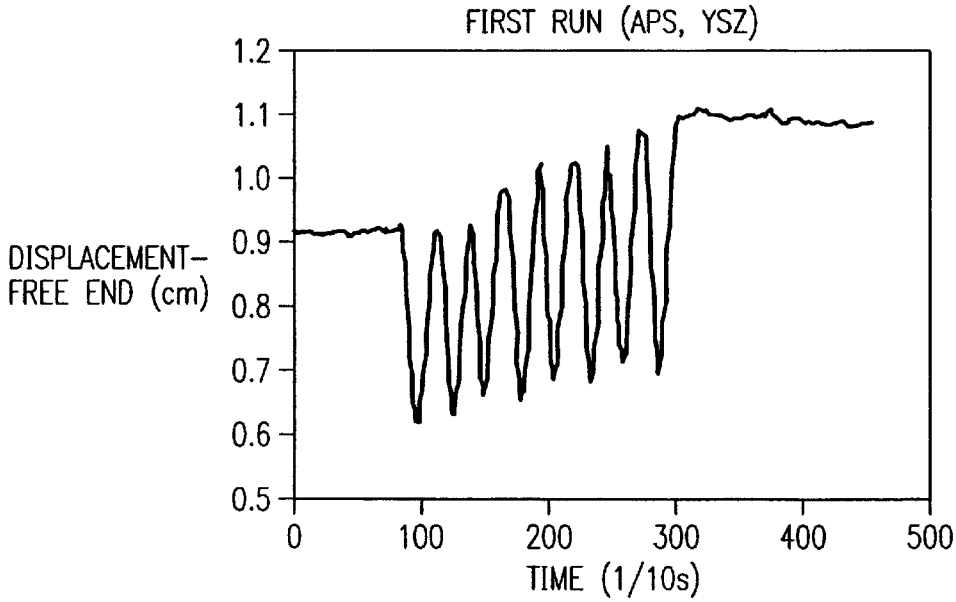
FIG. 8 is an expanded graph of displacement versus time from one of the exemplary displacement sensor outputs of the graph of FIG. 7.

The stream of the plasma and the particles emitted from the torch 102 has a transient effect on the curvature, as observed in the regions of higher oscillations during the two deposition sequences. One such region is enlarged in the graph of FIG. 8. The eight distinct 'dips' in the plot correspond to eight passages of the torch and the steady increase in the peak position corresponds to curvature evolution due to stress in the newly deposited layer.

Figure 9:
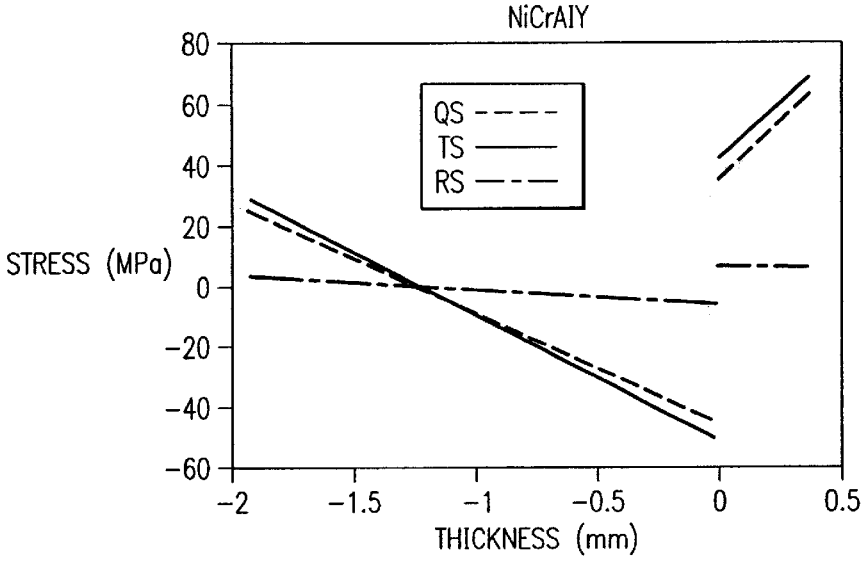
FIG. 9 is a graph of residual stress versus thickness in a plasma sprayed substrate.
Figure 10:
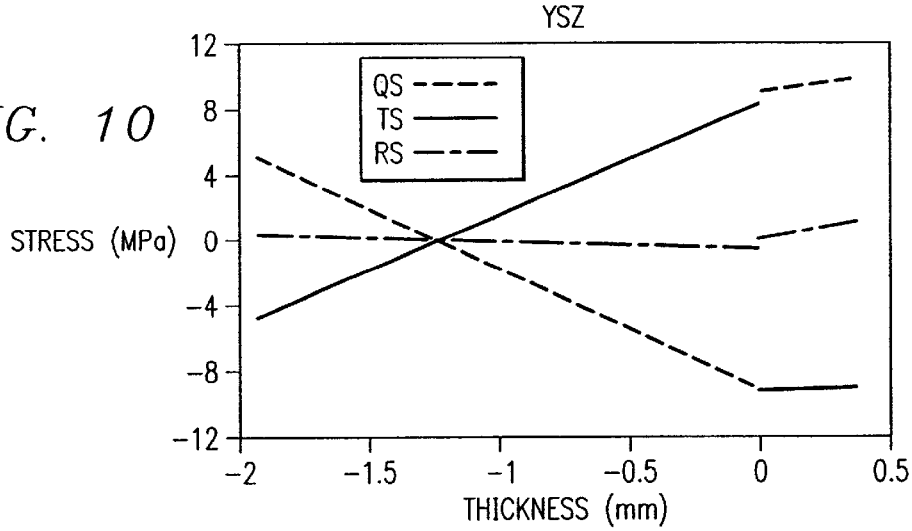
FIG. 10 is a graph of residual stress versus thickness in a plasma sprayed substrate.

FIGS. 9 and 10 are graphs which illustrate curvature measurements performed for NiCrAlY and $ZrO_2$+$Y_2O_3$ plasma sprayed deposits, respectively. The quenching stresses thus determined were 65 MPa and 10 MPa, respectively. From the value of quenching stress and from known deposition temperatures, thermal and mechanical properties, the through-thickness distributions of residual stresses were calculated, together with their quenching and thermal mismatch components. This can be performed using the procedure of Tsui and Clyne, "An Analytical Model for Predicting Residual Stresses in Progressively Deposited Coatings," Thin Solid Films, Vol. 306, No. 1, 1997, pp 23–61, which is hereby incorporated by reference in its entirety.

The Effects of Processing Parameters on Stress and Modulus

The results of a parametric study on plasma sprayed molybdenum deposits are summarized in FIGS. 9–14. Three parameters were varied: deposition temperature (Ts), (3 levels), thickness per pass (tp) and particle temperature+velocity (T+v) (2 levels both). Particle temperature and velocity is considered a single parameter (referred to as 'particle energy' in the graphs of FIGS. 9–14) due to a strong correlation between the two. These parameters were selected due to a high expectation that such variables would exhibit a strong influence and they are generally independent of characteristics of the particular spraying system.

Figure 11:
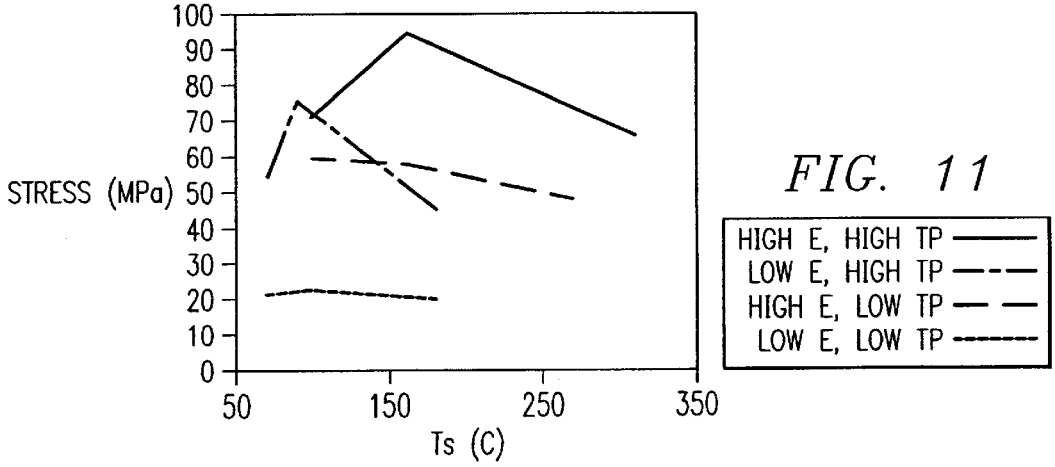
FIG. 11 is a graph of stress versus deposition temperature for various conditions of particle energy and thickness per pass.

FIG. 11 are graphs of quenching stress versus temperature for various conditions of particle energy and thickness per pass. The quenching stress for the high particle T+v condition was non-monotonous, with a maximum for medium Ts and lower values for both extremes. The deposition temperature affects the quenching stress in two ways (with opposite trends), that can explain this behavior:

- partial relief of stress in deposited layers by heat input from the new layers (higher at higher Ts)
- changes in intersplat bonding (improved at higher Ts)

It appears that at low temperature, the bonding is too low for the coating to hold a high stress; at high temperature, the quenching stress value is probably reduced by the heat input and both these effects are weaker in the medium Ts region. For the lower T+v condition, the quenching stress is largely indifferent of deposition temperature. Increasing T+v of the particles increased the quenching stress, probably due to better bonding of the particles (better wetting). Increasing the thickness per pass had the same effect. This is connected to the temperature effects on bonding—between each passage of the torch, the coating cools down certain amount and the substrate temperature the new splats see is near the average 'deposition temperature'. If the passage thickness is increased, more and more particles experience impact on splats that had arrived just before, during the same passage, therefore the interface temperature is significantly higher, thus promoting good contact (even epitaxial grain growth sometimes). Therefore, higher passage thickness generates fewer 'weak interfaces' and the deposit is able to hold higher stress levels.

Figure 12:
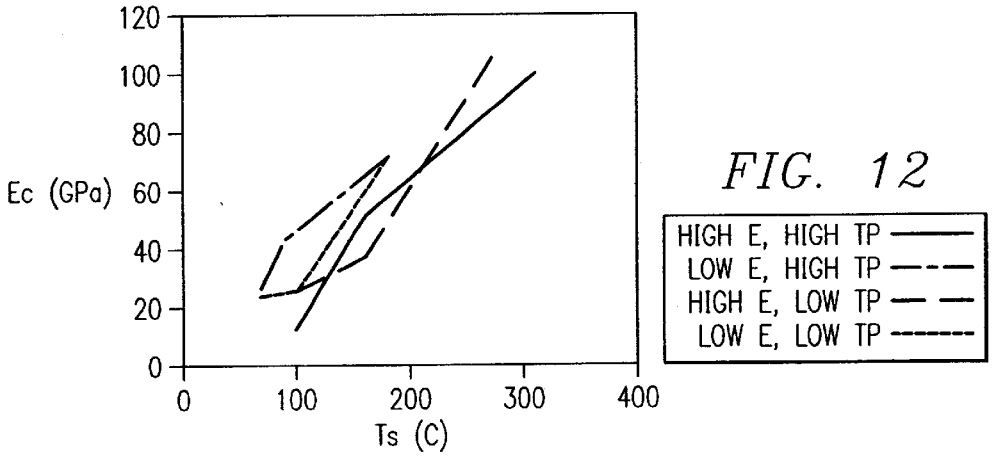
FIG. 12 is a graph of coating modulus versus deposition temperature for various conditions of particle energy and thickness per pass.

FIG. 12 is a graph illustrating coating modulus versus deposition temperature under varying conditions of particle energy (E) and thickness per pass (tp). Coating modulus increases significantly with deposition temperature due to improved contact between the splats. The effect of thickness per pass is rather insignificant. Increasing particle energy seems to decrease the modulus slightly.

Figure 13:
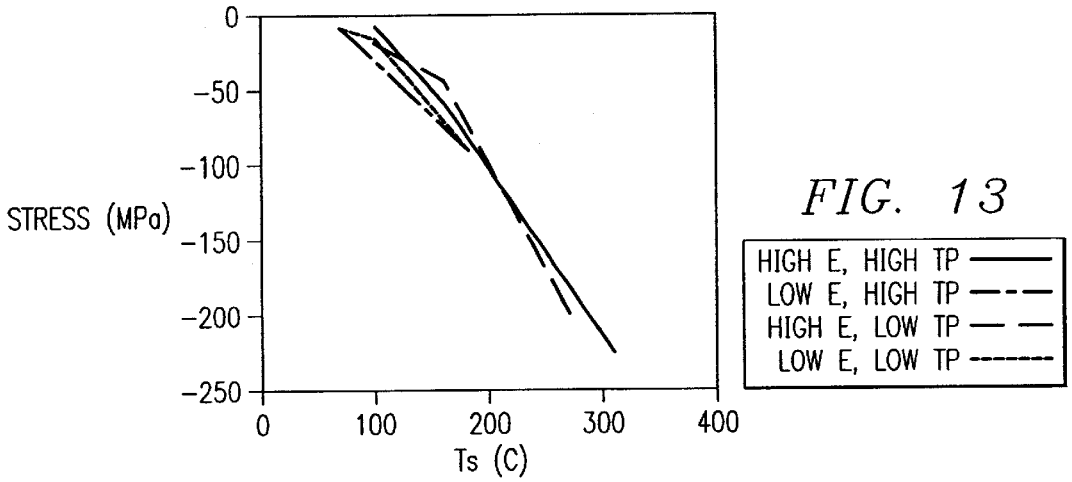
FIG. 13 is a graph of thermal stress versus deposition temperature for various conditions of particle energy and thickness per pass.

FIG. 13 are graphs of thermal stress versus deposition temperature. Thermal stress increase in magnitude with temperature. The other two parameters, particle energy and thickness per pass, have an insignificant influence on the variation in thermal stress. This stems from the fact that increasing temperature affects the thermal stress in two ways: First, by increasing the thermal mismatch; second by increasing the modulus. The higher the thermal mismatch and the higher the modulus, the higher the thermal stress.

Figure 14:
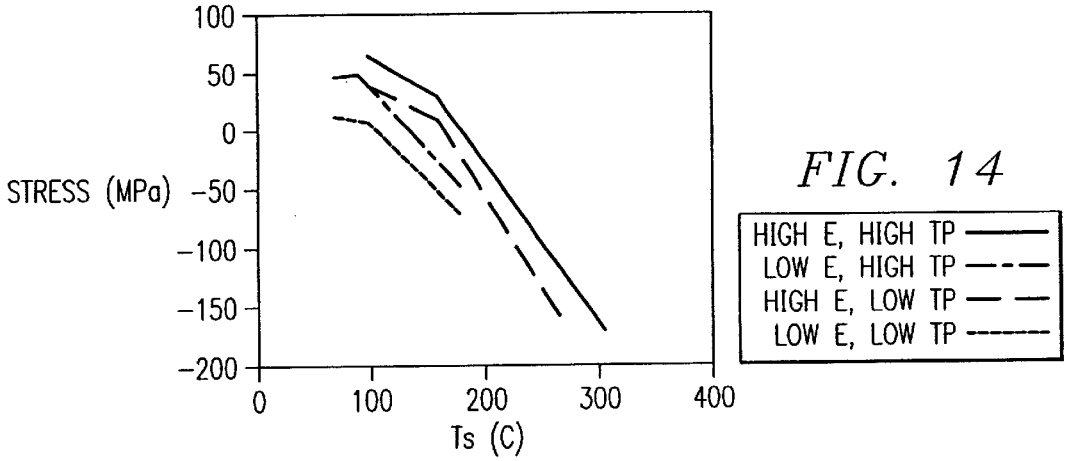
FIG. 14 is a graph of residual stress versus deposition temperature for various conditions of particle energy and thickness per pass.

FIG. 14 are graphs of residual stress versus deposition temperature under varying conditions of particle energy and thickness per pass. Residual stress is a significant property from the application point of view. The graphs illustrate that the stress can be changed between tensile and compressive by variation of these three parameters. The deposition temperature proves to be the most significant of the variable parameters in that for any combination of the other parameters, one can achieve either tensile or compressive (or zero) stress by varying the temperature. On the other hand, only the medium temperature region allows for the same variation in stress by other parameters; for the low temperatures, the stress is always tensile, and for high temperature compressive.

The results show that, for example, zero average stress can be achieved by a number of different combinations. Therefore, there is a range of parameters, within which one can choose to vary only some of them, so as to optimize the other properties.

The instrument and data analysis described above is not limited to thermal spraying, but can be used for stress and modulus determination in thin films deposited by any other technique, and in planar multilayers in general.

Using the present apparatus and methods, the qualities of a coating on a substrate can be determined in a non-destructive manner by using in-situ measurements during a deposition cycle. The present apparatus and methods offer flexible process control and quality management aspects. The present apparatus and methods are suitable for real-time process control during coating operations. Such and apparatus and methods are also useful for off-line quality assurance and archiving purposes.

Although the present invention has been described in connection with certain embodiments thereof, it will be understood that various alterations and modifications may be suggested to those skilled in the art. It is intended that such variants of the present invention fall within the scope of the invention, as set forth in the appended claims.

What is claimed is:

1. An apparatus for performing in-situ curvature measurement of a substrate during a deposition process, the substrate having a first surface, a second surface, a first end, a second end and a length there between, the apparatus comprising:

a clamp for retaining the substrate proximate the first end;

a plurality of displacement sensors, said sensors being arranged in spaced apart fashion along the length of the substrate and being directed to said first surface, each sensor providing a signal corresponding to a position of the substrate relative to said sensor; and a controller, said controller receiving and storing said signals from said plurality of displacement sensors to determine a stress evolution during a deposition process on said second surface and determining an elastic modulus of a coating based upon a resultant curvature of the substrate as determined by the sensor signals.

2. The apparatus of claim 1, further comprising a temperature sensor, said temperature sensor providing a signal to the controller indicative of the substrate temperature during a deposition process.

3. The apparatus of claim 1, further comprising a further displacement sensor, said further displacement sensor being directed to the second surface of the substrate, whereby deposition coating thickness can be determined.

4. The apparatus of claim 3, wherein said coating thickness is determined by both said further displacement sensor and at least one of said plurality of displacement sensors.

5. The apparatus for performinig in-situ curvature measurement of claim 1, wherein said controller uses an initial estimation of elastic modulus for the substrate and signals from the plurality of displacement sensors to determine an estimate of the residual stress on the substrate during a deposition process.

6. The apparatus for performing in-situ Curvature measurement of claim 1, wherein said controller acquires a plurality of values from said plurality of displacement sensors during a cooling cycle after deposition coating to determine a magnitude of curvature of the substrate.

7. The apparatus for performing in-situ curvature measurement of claim 1, wherein said controller calculates a thermal stress component of the substrate and deposition coating.

8. The apparatus for performing in-situ curvature measurement of claim 1, wherein said controller calculates a quenching stress component of the substrate and deposition coating.

* * * * *

UNITED STATES PATENT AND TRADEMARK OFFICE

CERTIFICATE OF CORRECTION

PATENT NO. : 6,478,875 B1
DATED : November 12, 2002
INVENTOR(S) : Sampath et al.

It is certified that error appears in the above-identified patent and that said Letters Patent is hereby corrected as shown below:

Column 1,
Line 11, insert:
-- Statement Regarding Federally Sponsored Research or Development This invention was made in part with Government support under National Science Foundation Grant DMR 9632570. The Government may have certain rights to the invention. --

Column 3,
Line 4, “cross sectional” should read -- cross-sectional --

Column 5,
Line 16, “gm” should read -- μm --

Column 7,
Line 8, “($F_\upsilon$)” should read -- ($F_\tau$) --; and “($\delta_\upsilon$)” should read -- ($\delta_\tau$) --

Column 8,
Line 41, “certain” should read -- a certain --
Line 65, “First,” should read -- first, --

Column 9,
Line 44, “there between” should read -- therebetween --

UNITED STATES PATENT AND TRADEMARK OFFICE

CERTIFICATE OF CORRECTION

PATENT NO. : 6,478,875 B1
DATED : November 12, 2002
INVENTOR(S) : Sampath et al.

It is certified that error appears in the above-identified patent and that said Letters Patent is hereby corrected as shown below:

Column 10,
Line 24, “performinig” should read -- performing --
Line 30, “Curvature” should read -- curvature --

Signed and Sealed this

Twenty-fourth Day of June, 2003

JAMES E. ROGAN
*Director of the United States Patent and Trademark Office*